US008336175B2

(12) United States Patent
Fang et al.

(10) Patent No.: US 8,336,175 B2
(45) Date of Patent: Dec. 25, 2012

(54) RIVETING PRESS

(75) Inventors: Hung-yuan Fang, Tu Cheng (TW); Mu-cun Chen, Tu Cheng (TW); Feng-chi Lee, Tu Cheng (TW); Kuo-chuan Chiu, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 364 days.

(21) Appl. No.: 12/854,845

(22) Filed: Aug. 11, 2010

(65) Prior Publication Data

US 2012/0036688 A1 Feb. 16, 2012

(51) Int. Cl.

| | |
|---|---|
| ***B23P 13/00*** | (2006.01) |
| *B23P 11/00* | (2006.01) |
| *B25B 27/02* | (2006.01) |

(52) U.S. Cl. ..... 29/2; 29/243.5; 29/281.1

(58) Field of Classification Search ..... 29/2, 238, 29/239, 243.5, 243.53, 243.54, 243.55, 281.1, 29/623.1, 623.2, 623.3, 623.4, 623.5, 729, 29/730, 731

See application file for complete search history.

(56) References Cited

U.S. PATENT DOCUMENTS

| | | | | |
|---|---|---|---|---|
| 3,634,917 | A * | 1/1972 | Kortick | 29/10 |
| 4,637,114 | A * | 1/1987 | Mathews, Sr. | 29/243.54 |
| 5,906,041 | A * | 5/1999 | Ito et al. | 29/809 |
| 6,279,224 | B1 * | 8/2001 | Wirtz et al. | 29/711 |
| 6,546,616 | B2 * | 4/2003 | Radowick | 29/720 |
| 6,687,971 | B2 * | 2/2004 | Nakamura | 29/430 |
| 2010/0257727 | A1 * | 10/2010 | Hiraki | 29/729 |

FOREIGN PATENT DOCUMENTS

JP 04365519 A * 12/1992

* cited by examiner

*Primary Examiner* — Brian Glessner
*Assistant Examiner* — Joseph J Sadlon
(74) *Attorney, Agent, or Firm* — Cheng-Ju Chiang

(57) ABSTRACT

Provided is a riveting press, which includes a base, a body frame fixed on the base, a riveting and pressing cylinder mounted on the body frame, and a pressing mechanism disposed between the base and the body frame. The pressing mechanism includes a first supporting unit having at least one first receiving hole, a second supporting unit having at least one second receiving hole, an elastic member accommodated into the first receiving hole, and a riveting and pressing punch passing through the second receiving hole. The first supporting unit is connected to the riveting and pressing cylinder. The second supporting unit is removable mounted on the first supporting unit. One end of the riveting and pressing punch is blocked on the first supporting unit and is contact with one end of the elastic member, and the other end of the riveting and pressing punch points to the base.

8 Claims, 5 Drawing Sheets

RIVETING PRESS

BACKGROUND OF THE INVENTION

1. Field of the Invention

The present invention relates to a machining equipment, and more particularly to a riveting press.

2. Description of the Prior Art

At present, with the development of technology, machining equipments instead of human operators complete manufacturing of various products. Wherein a riveting press used as one of the machining equipments has a wide using scope, such as electrical devices, automotive fittings, hardware tools, equipments and so on, to make components thereof form the rivet connection.

The prior riveting press commonly includes a base, a body frame positioned on the base, a riveting and pressing cylinder mounted on the body frame, and a pressing mechanism disposed between the base and the body frame and having a plurality of riveting and pressing punches. During the working process of the riveting press, the riveting and pressing cylinder drives the pressing mechanism to move up and down so that the riveting and pressing punches can be aligned to workpieces placed on the base for riveting and pressing. The pressing mechanism is an integral whole and the riveting and pressing punches designed for one specific workpiece are fixedly connected to it. Because this prior riveting press is only adapted to rivet and press one workpiece having a specific size, the use of this prior riveting press is single. Moreover, during the course of using this prior riveting press, the riveting and pressing punch is easily damaged or deformed due to frequent friction between it and the workpiece thereby reducing the machining precision. Therefore, when the structure or the size of the workpiece is slightly modified, the riveting press must be replaced as a new riveting press with a new riveting and pressing punch corresponding to the modified workpiece. And if the damaged riveting and pressing punch has affected the machining precision, the whole riveting press also needs to be replaced as a new riveting press, thus this can result in a serious waste of resources.

BRIEF SUMMARY OF THE INVENTION

An object of the present invention is to provide a riveting press, which can be conveniently replaced to satisfy different need of riveting and pressing, and has a wide use and can largely save resources.

To achieve the above object, in accordance with the present invention, a riveting press is provided, comprising a base, a body frame fixed on the base, a riveting and pressing cylinder mounted on the body frame, and a pressing mechanism disposed between the base and the body frame. The pressing mechanism comprises a first supporting unit having at least one first receiving hole, a second supporting unit having at least one second receiving hole, an elastic member accommodated into the first receiving hole, and a riveting and pressing punch passing through the second receiving hole. The first supporting unit is connected to the riveting and pressing cylinder. The second supporting unit is removable mounted on the first supporting unit. One end of the riveting and pressing punch is blocked on the first supporting unit and is contact with one end of the elastic member, and the other end of the riveting and pressing punch points to the base.

Based on the above description, the riveting press as provided by the present invention has a plurality of the pressing punches movable mounted on the second supporting unit. The second supporting unit is further removable mounted on the second supporting unit. Therefore the destroyed pressing punches of the present riveting press can be conveniently replaced as new punches for satisfying different need, thereby making the riveting press have a wide use and largely save resources.

DETAILED DESCRIPTION OF THE PREFERRED EMBODIMENTS

The following embodiment with reference to the accompanying drawings now has been given for detail describing the technology, the feature, the object and the effect of the present invention.

Figure 1:
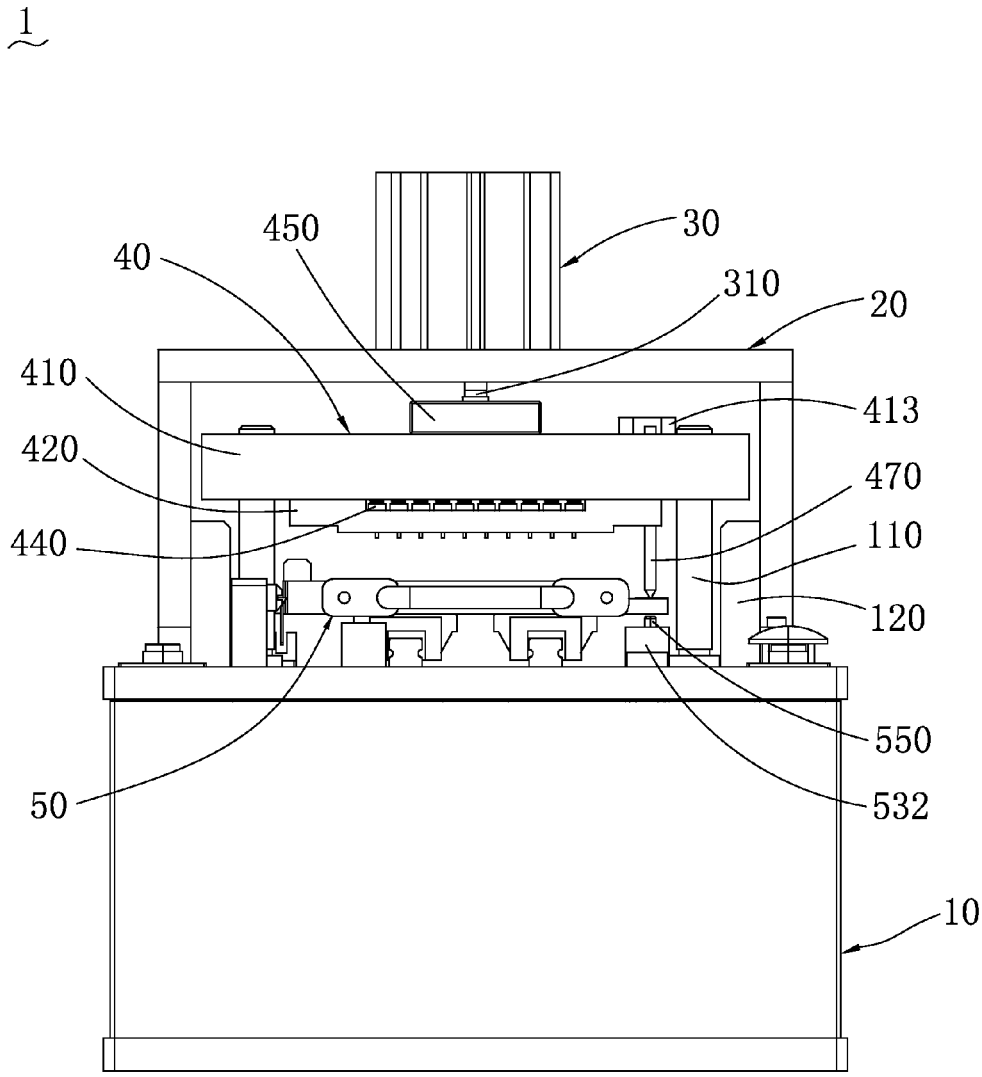
FIG. 1 is a front view of a riveting press according to one embodiment of the present invention.
Figure 2:
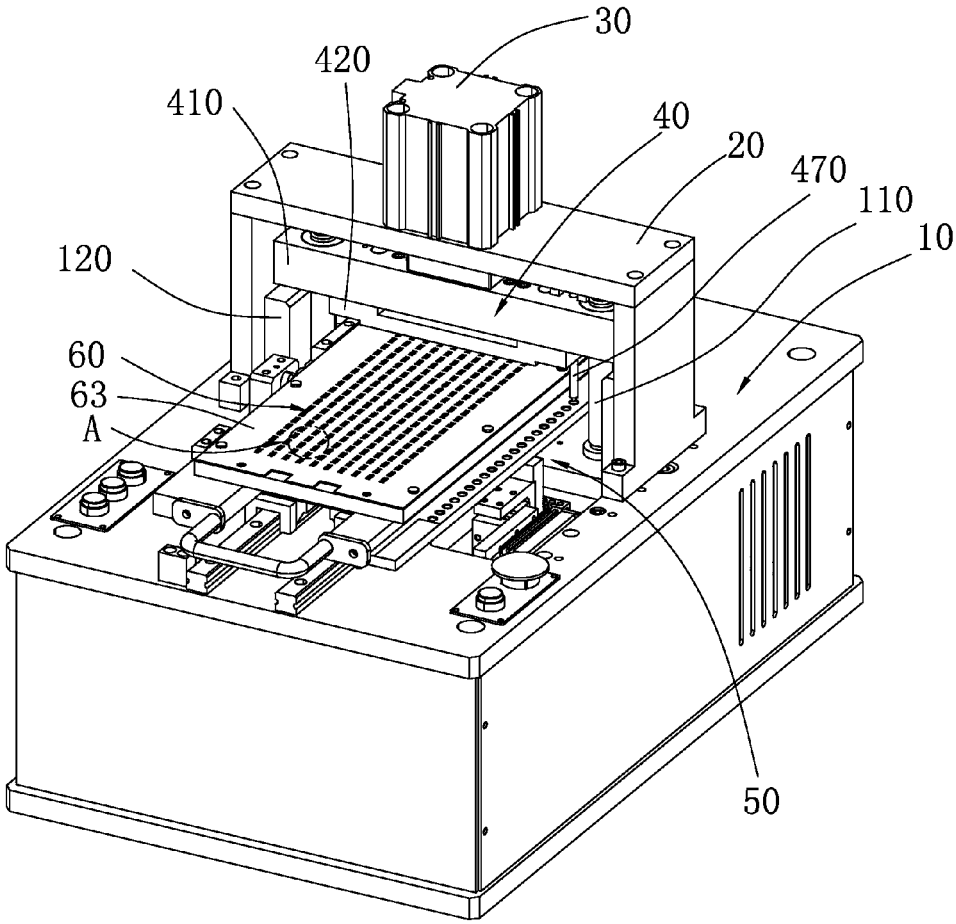
FIG. 2 is a perspective view of the riveting press of FIG. 1, on which workpieces are positioned.
Figure 3:
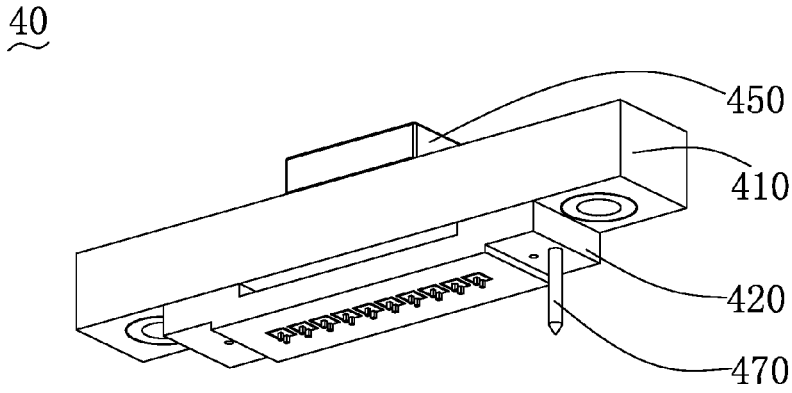
FIG. 3 is a perspective view of a pressing mechanism of the riveting press of FIG. 1.
Figure 4:
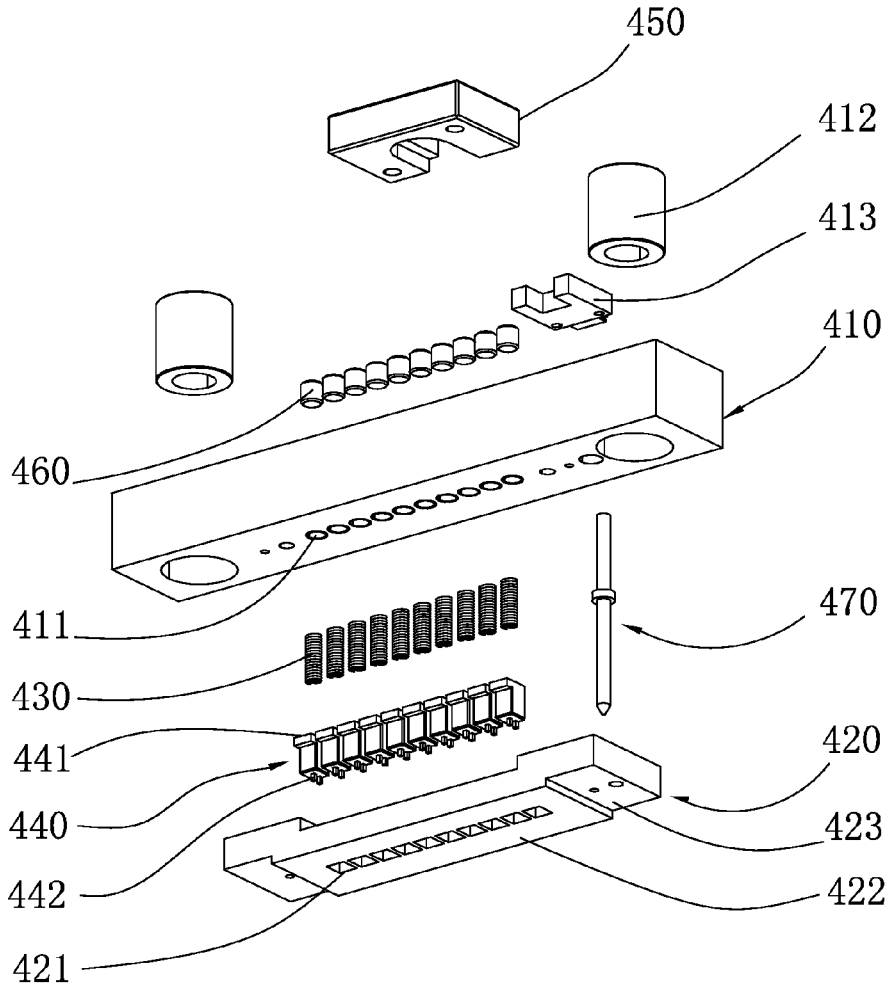
FIG. 4 is an exploded view of the pressing mechanism of FIG. 3.
Figure 5A:
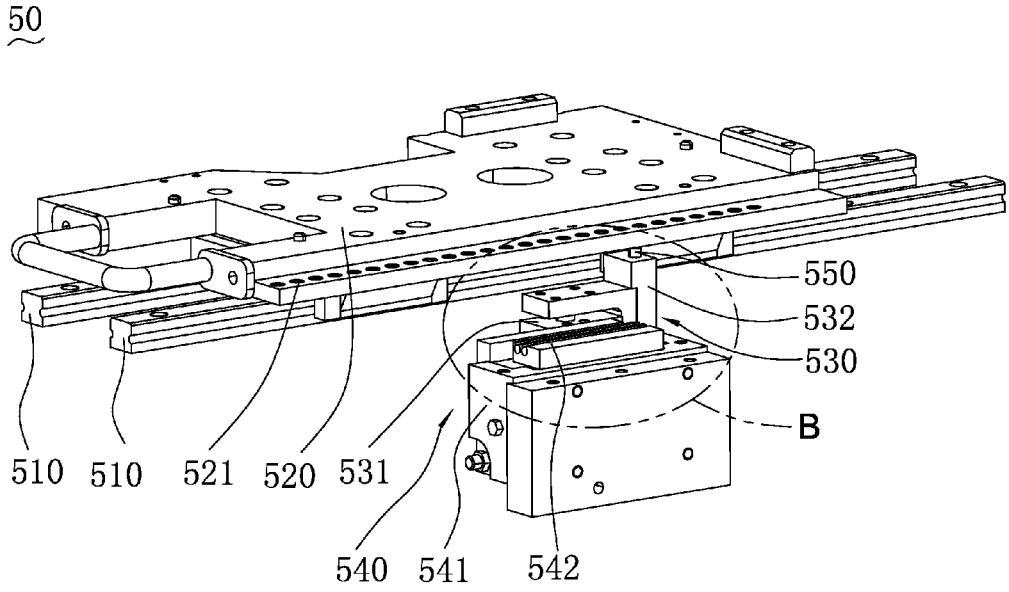
FIG. 5*a* is a perspective view of a material-feeding module of the riveting press of FIG. 1.
Figure 5B:
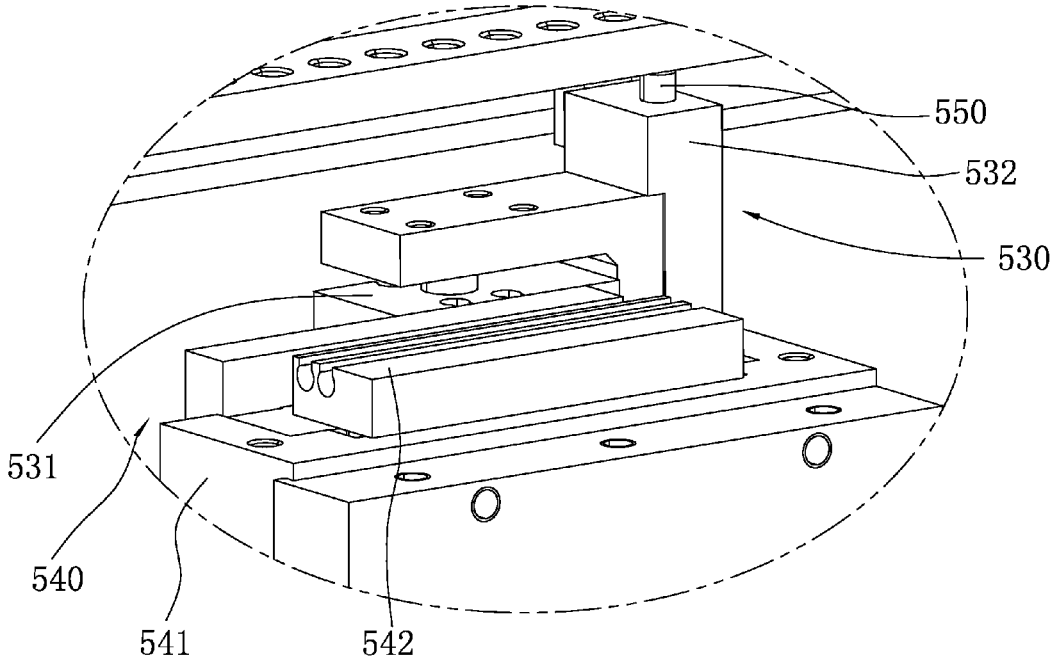
FIG. 5*b* is an enlarged view of part B of FIG. 5*a;*
Figure 6:
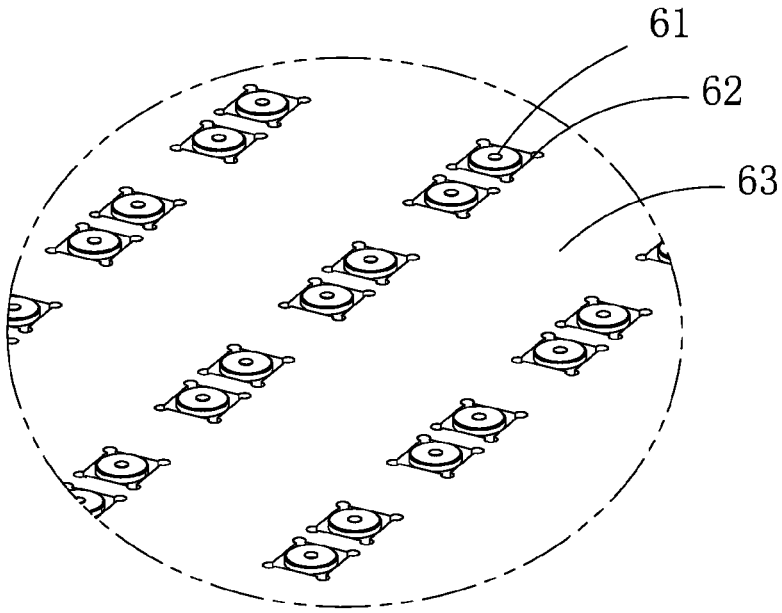
FIG. 6 is an enlarged view of part A of FIG. 2.

Please refer to FIG. 1, a riveting press 1 at least comprises a base 10, a body frame 20 fixed on the base 10, a riveting and pressing cylinder 30 mounted on the body frame 20, and a pressing mechanism 40 disposed between the base 10 and the body frame 20.

Referring to FIGS. 1 to 4, the pressing mechanism 40 includes a first supporting unit 410, a second supporting unit 420, a plurality of elastic members 430, and a plurality of riveting and pressing punches 440. The first supporting unit 410 has a plurality of first receiving holes 411. The second supporting unit 420 includes a platform portion 422, two mounting portions 423 separately extending from two ends of the platform portion 422 and being higher than the platform portion 422, and a plurality of second receiving holes 421 corresponding to the first receiving holes 411. Each riveting and pressing punch 440 has a projecting portion 441 formed on a top end thereof and two riveting and pressing feet 442 formed on a bottom end thereof. Each riveting and pressing punch 440 passes through the corresponding second receiving hole 421, wherein the projecting portion 441 is blocked to move downward and is emerged from a top surface of the platform portion 422, and the two riveting and pressing feet 442 are protruding from a bottom surface of the platform portion 422. Each elastic member 430 is accommodated into the corresponding first receiving hole 411. The mounting portions 423 of the second supporting unit 420 are removable mounted on the first supporting unit 410. The projecting portion 441 of each riveting and pressing punch 440 is contacted with a lower end of the corresponding elastic member 430. The two riveting and pressing feet 442 of each riveting and pressing punch 440 point to the base 10. In this embodiment, the elastic members 430 are springs, but not limited by the spring, and any elastic member having tensile force may be adopted.

The pressing mechanism 40 further includes a supporting flange 450 fixed on the first supporting unit 410. The riveting and pressing cylinder 30 includes a telescopic pole 310 connected to the first supporting unit 410 by the supporting flange 450. The riveting and pressing cylinder 30 can control the telescopic pole 310 to telescope up and down for driving the pressing mechanism 40 to move up and down, so that the riveting and pressing punches 440 can rivet and press workpieces 60 placed on the base 10.

Preferably, the pressing mechanism 40 also includes a plurality of setscrews 460. Each first receiving hole 411 has a screw structure engaged with the setscrew 460. Each setscrew 460 is mounted in the corresponding first receiving hole 411 and faces to a top end of the elastic member 430. Each riveting and pressing punch 440 is separately designed. Adjusting the position of the setscrew 460 in the first receiving hole 411 can change the compression of the corresponding elastic member 430 for controlling the press force of the riveting and pressing punch 440 thereby reducing the tolerance of the machining depth of the riveting and pressing punch 440.

Preferably, the base 10 has two guiding posts 110 perpendicularly stood on a top surface thereon. Two bearings 412 are separately mounted on two ends of the first supporting unit 410. Each bearing 412 is slidably coupled to the corresponding guiding post 110 so that the whole pressing mechanism 40 can slide up and down along the two guiding posts 110 in the perpendicular direction of the top surface of the base 10.

Preferably, two limiting stoppers 120 are disposed on the top surface of the base 10, and are located below the first supporting unit 410 to prevent the pressing mechanism 40 from overly pressing the workpieces thereby protecting the workpieces and the riveting and pressing punches 440.

Referring to FIGS. 1, 2 and 5*a*, 5*b*, the present riveting press 1 also comprises a material-feeding module 50 having two sliding rails 510, a movable platform 520, a vertical cylinder 530, a horizontal cylinder 540 and a material-feeding locating dowel 550. The two sliding rails 510 are fixed on the base 10. The movable platform 520 is mounted on the two sliding rails 510. The vertical cylinder 530 and the horizontal cylinder 540 are located below the movable platform 520. The horizontal cylinder 540 includes a horizontal positioning portion 541 fixed on the base 10 and a horizontal movable portion 542 being capable of moving along the sliding rails 510. The vertical cylinder 530 includes a vertical positioning portion 531 fixedly connected to the horizontal movable portion 542, and a vertical movable portion 532 moving up and down perpendicularly to the movable platform 520. Pluralities of positioning holes 521 formed on the movable platform 520 are arranged with an equal interval along the sliding rails 510. One end of the material-feeding locating dowel 550 is fixed on the vertical movable portion 532 of the vertical cylinder 530, and the other end thereof is corresponding to the positioning holes 521. The material-feeding module 50 employs the vertical cylinder 530 and the horizontal cylinder 540 to make the machining-waiting workpiece 60 on the movable platform 520 be capable of moving at equal interval, thereby realizing automatic feeding and enhancing the manufacturing efficiency.

Preferably, the first supporting unit 410 disposes a photoelectric switch 413, which is connected to a control system (not shown in all FIGS) in the base 10. The pressing mechanism 40 also includes a press locating dowel 470 passing through the first supporting unit 410 and the second supporting unit 420. One end of the press locating dowel 470 is aligned to the photoelectric switch 413, and the other end thereof is corresponding to the positioning holes 521. The location of an arranging tray 63, which is placed on the movable platform 520 to carry the workpieces 60, can be checked by these designs of the press locating dowel 470 and photoelectric switch 413. If the location of the arranging tray 63 is wrong or has a little deviation, the locating dowel 470 can not be inserted into the corresponding positioning holes 521, but be lift up to touch and start the photoelectric switch 413 so that the control system connected with the photoelectric switch 413 can make every cylinder stop working Therefore, the riveting press 1 and the workpieces 60 can avoid to be damaged.

Referring to FIGS. 1 to 7, the following working process of the present riveting press 1 is illustrated by the example of a spring probe connector as the workpiece 60.

First, insulating housings 62 and spring probes 61 are placed on the arranging tray 63 by an arranging machine (not shown in all FIGS). Second, the arranging tray 63 is placed on the movable platform 520 of the riveting press 1. Then, the movable platform 520 is push to an initial position. Next the riveting press 1 is started so that the control system can control every cylinder's actions. The actions of every cylinder are as follows.

Figure 7:
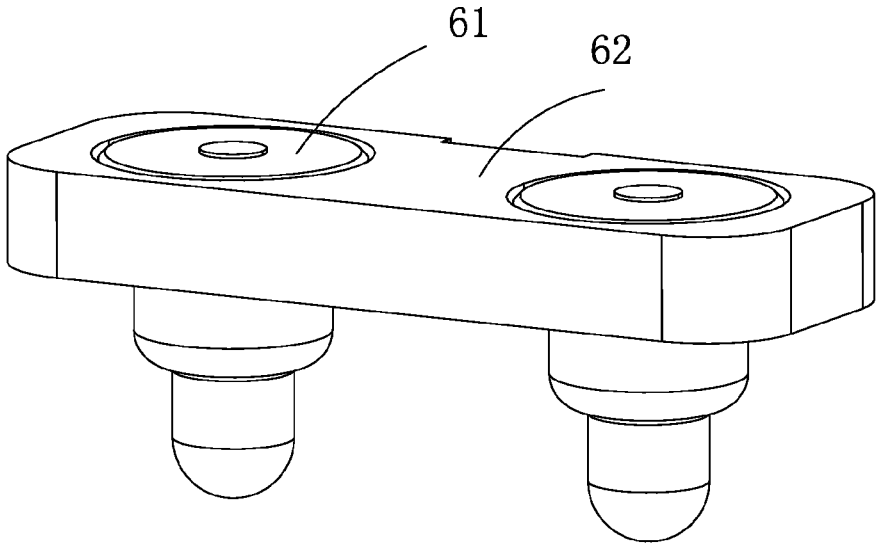
FIG. 7 is a schematic view of two spring probes mounted on an insulating housing.

After the riveting press 1 being started, the vertical movable portion 532 of the vertical cylinder 530 can move upward so that the material-feeding locating dowel 550 fixed thereon can be inserted into the corresponding positioning hole 521. Then, the horizontal movable portion 542 of the horizontal cylinder 540 can go horizontally forward one step, correspondingly the movable platform 520 moving along with it can go one step toward the pressing mechanism 40. Now, a first row of the workpieces 60 placed on the arranging tray 63 is aligned with the pressing punches 440 of the pressing mechanism 40, and they are one-to-one correspondence. Next, the riveting and pressing cylinder 30 extends its telescopic pole 310 to push the pressing mechanism 40 moving downward, and the two riveting and pressing feet 442 of every pressing punch 440 separately depress the corresponding two spring probes 61 so that the two spring probes 61 can be fixedly connected to the insulating housing 62, as shown in FIG. 7. Subsequently, the riveting and pressing cylinder 30 retracts its telescopic pole 310 to pull the pressing mechanism 40 moving upward, the pressing punches 440 return to the original position, the vertical movable portion 532 of the vertical cylinder 530 moves downward to make the material-feeding locating dowel 550 be detached form the corresponding positioning hole 521, and the horizontal movable portion 542 of the horizontal cylinder 540 together with the vertical cylinder 530 goes one step backward to return to the original position. Now, the material-feeding locating dowel 550 can be aligned with the next positioning hole 521 for ready to rivet and press next row of the workpieces 60. Whereby the actions of the riveting press 1 can be cycled and cannot stop until the last row of the workpieces 60, which is judged by the control system, is machined.

As described above, the pressing punches 440 of the present riveting press 1 is movable mounted on the second supporting unit 420. The second supporting unit 420 is further removable mounted on the second supporting unit 420. Therefore the pressing punches 440 of the present riveting press 1 can be conveniently replaced as new punches for satisfying different need, thereby making the riveting press 1 have a wide use and largely save resources.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A riveting press comprising:

a base;

a body frame, being fixed on the base;

a riveting and pressing cylinder, being mounted on the body frame; and a pressing mechanism, being disposed between the base and the body frame;

wherein the pressing mechanism comprises a first supporting unit having at least one first receiving hole, a second supporting unit having at least one second receiving hole, an elastic member accommodated into the first receiving hole, and a riveting and pressing punch passing through the second receiving hole; the first supporting unit is connected to the riveting and pressing cylinder; the second supporting unit is removable mounted on the first supporting unit; one end of the riveting and pressing punch is blocked on the first supporting unit and contacts with one end of the elastic member, and the other end of the riveting and pressing punch points to the base.

2. The riveting press as claimed in claim 1, wherein the pressing mechanism further includes at least one setscrew, the first receiving hole has a screw structure engaged with the setscrew, and the setscrew is mounted in the first receiving hole and corresponding to the other end of the elastic member.

3. The riveting press as claimed in claim 1, wherein two guiding posts are disposed on the base, two bearings are separately mounted on two ends of the first supporting unit, and each bearing is slidably coupled to the corresponding guiding post.

4. The riveting press as claimed in claim 1, wherein at least one limiting stopper is disposed on the base and located below the first supporting unit.

5. The riveting press as claimed in claim 1, wherein the pressing mechanism further includes a supporting flange fixed on the first supporting unit, and the riveting and pressing cylinder includes a telescopic pole connected to the first supporting unit by the supporting flange.

6. The riveting press as claimed in claim 1, further comprising:

a material-feeding module, including at least one sliding rail, a movable platform, a vertical cylinder, a horizontal cylinder and a material-feeding locating dowel;

wherein the sliding rail is fixed on the base; the movable platform is mounted on the sliding rail; the vertical cylinder and the horizontal cylinder are located below the movable platform; the horizontal cylinder includes a horizontal positioning portion fixed on the base, and a horizontal movable portion capable of moving along the sliding rail; the vertical cylinder includes a vertical positioning portion fixedly connected to the horizontal movable portion, and a vertical movable portion capable of moving up and down perpendicularly to the movable platform; pluralities of positioning holes are arranged on one side of the movable platform along the sliding rail; one end of the material-feeding locating dowel is fixed on the vertical movable portion of the vertical cylinder, and the other end thereof is corresponding to one of the positioning holes.

7. The riveting press as claimed in claim 6, wherein the positioning holes on the movable platform are arranged with an equal interval along the sliding rail.

8. The riveting press as claimed in claim 6, wherein a photoelectric switch is disposed on the first supporting unit and is connected to a control system in the base; the pressing mechanism also includes a press locating dowel passing through the first and second supporting unit; one end of the press locating dowel is aligned to the photoelectric switch, and the other end thereof is corresponding to one of the positioning holes.

* * * * *